US007733362B2

(12) United States Patent
Kanzaki et al.

(10) Patent No.: US 7,733,362 B2
(45) Date of Patent: Jun. 8, 2010

(54) OPTICAL WRITING DEVICE AND IMAGE FORMING APPARATUS

(75) Inventors: Yoshio Kanzaki, Tokyo (JP); Yasuhiro Abe, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 17 days.

(21) Appl. No.: 12/035,056

(22) Filed: Feb. 21, 2008

(65) Prior Publication Data

US 2008/0205934 A1 Aug. 28, 2008

(30) Foreign Application Priority Data

Feb. 22, 2007 (JP) ..... 2007-042019
Jan. 7, 2008 (JP) ..... 2008-000586

(51) Int. Cl.
*B41J 2/435* (2006.01)

(52) U.S. Cl. ..... 347/236; 347/246

(58) Field of Classification Search ..... 347/236–237, 347/246–247, 132, 133, 135
See application file for complete search history.

(56) References Cited

U.S. PATENT DOCUMENTS 5,561,285 A * 10/1996 Sakata et al. ..... 250/205
5,933,266 A * 8/1999 Minakuchi ..... 359/196.1

FOREIGN PATENT DOCUMENTS

| | | |
|---|---|---|
| JP | 2-24431 | 5/1990 |
| JP | 8-295048 | 11/1996 |
| JP | 2002-182146 | 6/2002 |
| JP | 3880914 | 11/2006 |
| JP | 2007-148356 | 6/2007 |

* cited by examiner

*Primary Examiner*—Hai C Pham
(74) *Attorney, Agent, or Firm*—Dickstein Shapiro LLP

(57) ABSTRACT

A rotating deflection unit deflects a laser light emitted from a light-emitting element and performs a scanning with the laser light. A light-intensity detecting unit detects a light intensity of the laser light. A current control unit controls a current to be supplied to the light-emitting element so that the light intensity of the laser light reaches a target light intensity. An initializing unit determines an initial current value with which the target light intensity is obtained from the light-emitting element by eliminating an influence of a noise caused by a reflected light input into the light-intensity detecting unit from the rotating deflection unit.

4 Claims, 15 Drawing Sheets

OPTICAL WRITING DEVICE AND IMAGE FORMING APPARATUS

CROSS-REFERENCE TO RELATED APPLICATIONS

The present application claims priority to and incorporates by reference the entire contents of Japanese priority document 2007-042019 filed in Japan on Feb. 22, 2007, and 2008-000586 filed in Japan on Jan. 7, 2008.

BACKGROUND OF THE INVENTION

1. Field of the Invention

The present invention relates to an optical writing device and an image forming apparatus employing the optical writing device.

2. Description of the Related Art

An image forming apparatus, such as a digital photocopier or a laser printer, deflects a laser light to be emitted in accordance with image data in a main scanning direction by rotating a polygon mirror, and forms an electrostatic latent image that is formed on a photosensitive element moving in a sub-scanning direction. An optical writing device in such image forming apparatus generally performs automatic power control (APC). According to the APC control, to keep a light intensity of a laser light emitted from a laser diode (LD) constant, the light intensity of the laser light is detected by a light-receiving element, such as a photo diode, and the value of a current to illuminate the LD is controlled based on the detected light intensity. A photo diode is included in an LD unit together with the LD. More specifically, the photo diode is sometimes arranged in the vicinity of the LD inside the LD unit in some cases.

To eliminate influences caused by, such as individual differences of the LD, time-lapse fluctuations, and temperature fluctuations, the optical writing device that performs the APC control generally performs an initializing operation that determines an initial value of an LD drive current to obtain a target light intensity. For example, according to an initializing operation described in Japanese Patent Application Laid-Open No. 2004-153118, a current supplied to the LD is increased until the light intensity of the laser light emitted from the LD reaches a reference value, and the value of a current at a moment when the light intensity of the laser light reaches the reference value is set as the initial value of the LD drive current.

The image forming apparatus is configured such that the laser light from the LD is reflected by the polygon mirror, and irradiated to the photosensitive element via a plurality of lenses and reflection mirrors. However, when the laser light is reflected by the polygon mirror in accordance with an optical condition of the regular reflection (at 90 degrees of the incident angle), the reflected light sometimes returns directly into the inside of the LD unit in some cases. Such phenomenon is called as a reflected light. If the reflected light is generated, a receiving-light amount received by the photo diode inside the LD unit increases to more than a usual state. For this reason, it is desirable to detect the light intensity of the LD by eliminating influence of the reflected light.

However, according to Japanese Patent Application Laid-Open No. 2004-153118, a current to be supplied to the LD is increased until the light intensity of the laser light emitted from the LD reaches the reference value, and the current to be supplied to the LD is controlled based on the value of the current at a moment when the light intensity of the laser light reaches the reference value, so that the optical writing device tends to receive an adverse effect of a reflected light.

Consequently, sometimes the initializing operation is not properly performed due to an influence of the reflected light, which causes a problem that the quality of an image is degraded due to a failure of initialization.

SUMMARY OF THE INVENTION

It is an object of the present invention to at least partially solve the problems in the conventional technology.

According to an aspect of the present invention, there is provided an optical writing device including a light-emitting element that emits a laser light; a rotating deflection unit that deflects the laser light and that performs a scanning with the laser light; a light-intensity detecting unit that detects a light intensity of the laser light; a current control unit that controls a current to be supplied to the light-emitting element in such manner that the light intensity of the laser light reaches a target light intensity; and an initializing unit that determines an initial current value with which the target light intensity is obtained from the light-emitting element by eliminating an influence of a noise caused by a reflected light input into the light-intensity detecting unit from the rotating deflection unit.

Furthermore, according to another aspect of the present invention, there is provided an image forming apparatus that forms an electrostatic latent image on an image carrier by irradiating the image carrier with a laser light and forms a toner image on a recording medium by developing the electrostatic latent image with toner. The image forming apparatus includes an optical writing device that scans the image carrier with a laser light to form electrostatic latent image on the image carrier. The optical writing device includes a light-emitting element that emits a laser light, a rotating deflection unit that deflects the laser light and that performs a scanning with the laser light, a light-intensity detecting unit that detects a light intensity of the laser light, a current control unit that controls a current to be supplied to the light-emitting element in such manner that the light intensity of the laser light reaches a target light intensity, and an initializing unit that determines an initial current value with which the target light intensity is obtained from the light-emitting element by eliminating an influence of a noise caused by a reflected light input into the light-intensity detecting unit from the rotating deflection unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained in detail below with reference to the accompanying drawings. The present invention is not limited to the embodiments. Components according to the embodiments include components that can be easily conceived by a person skilled in the art, or the substantially same components as conventional ones.

Figure 1:
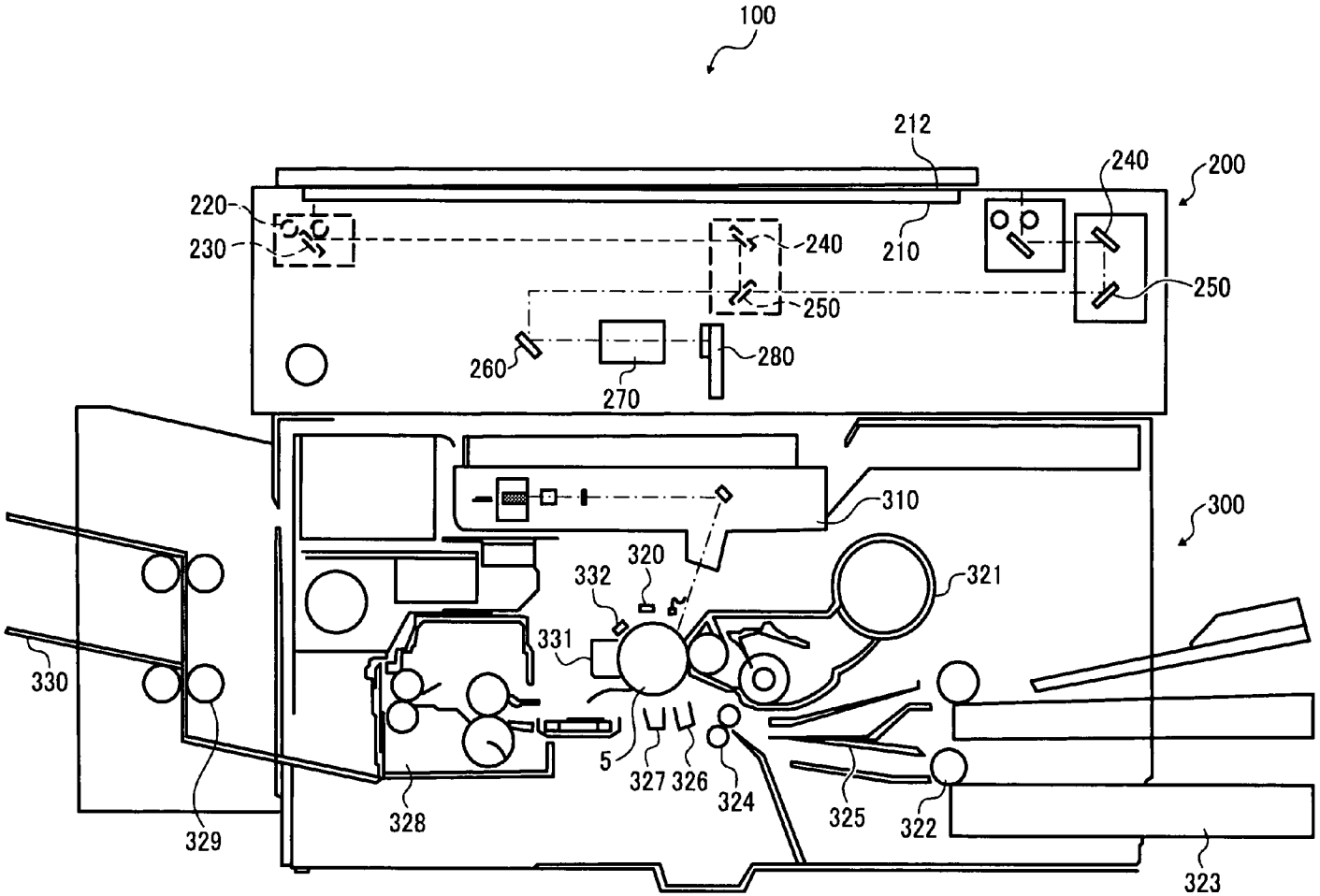
FIG. 1 is a schematic diagram of an image forming apparatus according to a first embodiment of the present invention.

An image forming apparatus 100 according to a first embodiment of the present invention shown in FIG. 1 is a monochrome digital photocopier according to electrophotography that forms an electrostatic latent image by irradiating a laser light, and forms a toner image corresponding to the formed electrostatic latent image onto paper.

As shown in FIG. 1, the image forming apparatus 100 includes a scanner unit 200, and an engine unit 300 that forms an image read by the scanner unit 200.

The scanner unit 200 is configured to convert document information based on a document 212 to an image signal by scan-exposing the document 212 placed on a platen 210. An exposing lamp 220 inside the scanner unit 200 performs scan-exposing along the platen 210.

A reflected light from the document 212 is photoelectrically converted by a charge-coupled device (CCD) sensor 280 via a carriage mirror 230, a first-half scanning mirror 240, a second-half scanning mirror 250, an imaging mirror 260, and an optical lens 270, and then turned to an electric signal corresponding to the reflected light. An image processing unit 400 (see FIG. 3) performs image processing on an image signal created by the photoelectric conversion, and then the image signal is sent to the engine unit 300.

The engine unit 300 includes a photosensitive drum 5 that rotates regularly and is uniformly charged by an electric charger 320 that is an electrostatically-charging device. The engine unit 300 forms an electrostatic latent image by exposing the photosensitive drum 5 with a laser light from an optical writing device 310. The electrostatic latent image formed on the photosensitive drum 5 is developed with toner by a developing unit 321, and then turned to a visible image.

Meanwhile a paper feeding roller 322 feeds and conveys a paper 325 in advance from a paper feeding tray 323. Registration rollers 324 convey the paper 325, which has been waiting, in a synchronized manner with driving of the photosensitive drum 5. A transfer charger 326 that is a transferring device then electrostatically transfers the toner on the photosensitive drum 5 to the paper 325, and then a paper separating charger 327 separates the paper 325 from the photosensitive drum 5. After separating the paper 325, a fixing unit 328 heats and fixes a toner image on the paper 325, and then paper-delivery rollers 329 deliver the paper 325 to a paper-delivery tray 330.

On the other hand, a cleaning unit 331 removes the toner image remaining on the photosensitive drum 5 after the electrostatic transfer by contacting the photosensitive drum 5 with pressure, and the photosensitive drum 5 is statically eliminated with an irradiated light from a neutralizing lamp 332.

As described above, the image forming apparatus 100 forms an image by repeating a series of the processes.

Figure 2:
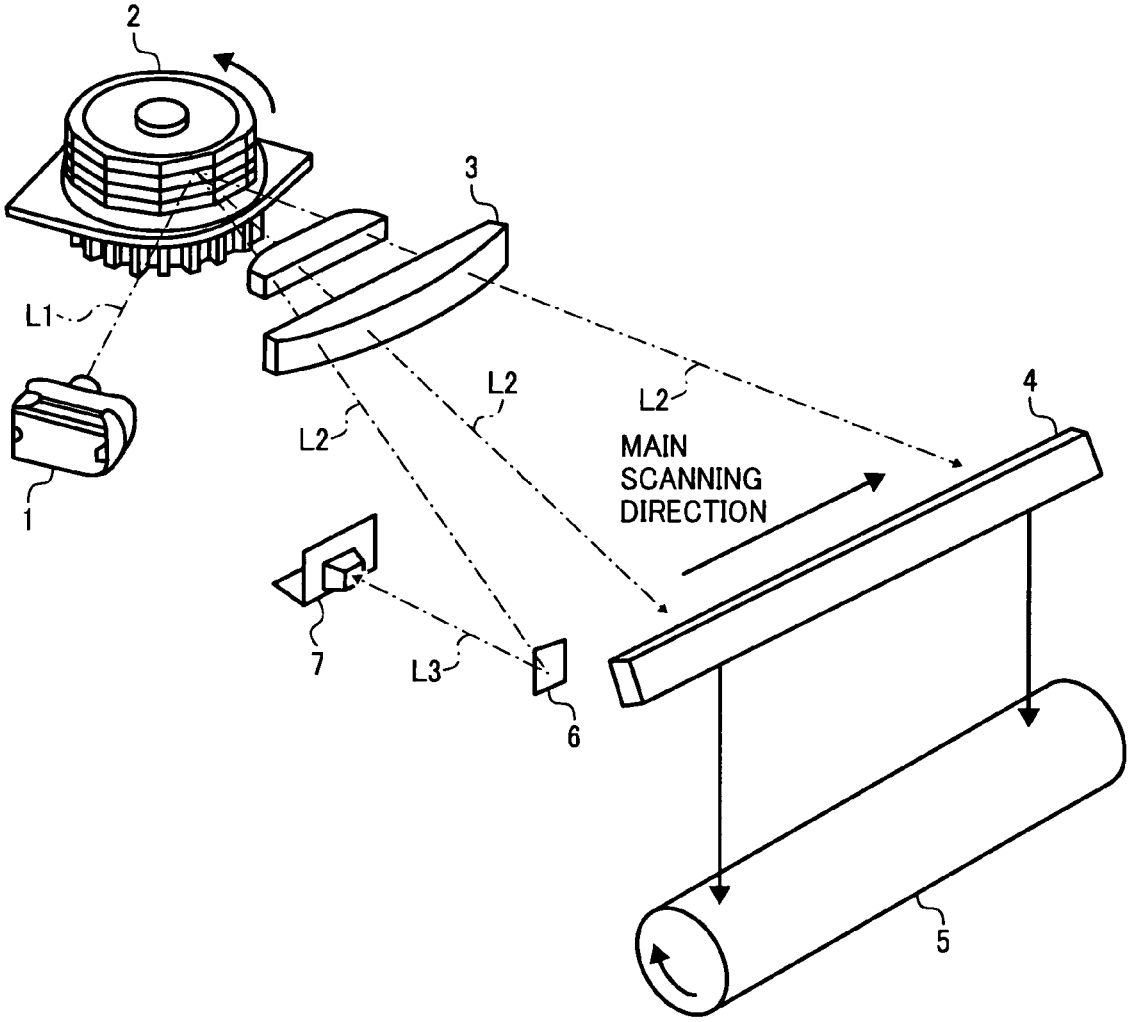
FIG. 2 is a schematic diagram for explaining operation of an optical writing device shown in FIG. 1.

During the processes, the optical writing device 310 included in the engine unit 300 is configured to expose the photosensitive drum 5 with a laser light by scanning. Specifically, as shown in FIG. 2, the optical writing device 310 emits a collimated laser light L1 an LD unit 1 with a collimator lens, deflects the laser light L1 emitted with the collimator lens as a laser light L2 for scanning with a polygon mirror 2 that is a deflection unit, and causes the laser light L2 to form an image on a charged surface of the photosensitive drum 5 in a drum shape via an image forming lens made of an f-θ lens 3, and a reflecting mirror 4. During the process, the laser light L1 is modulated based on the image signal, repeats illuminating and shutting-off, repeatedly scans in the main scanning direction in accordance with rotating of the polygon mirror 2, and forms an electrostatic latent image on the photosensitive drum 5 as the photosensitive drum 5 performs the sub-scanning by rotating.

The electrostatic latent image formed in this way is developed with an electrostatically-charged developer (toner), and as the paper 325 charged inversely to the developer is made touch closely to the photosensitive drum 5, the developer is then transferred onto the paper 325. After the paper 325 is separated from the photosensitive drum 5, the developer is fused and fixed onto the paper 325 by being heated.

A synchronization detecting mirror 6 is arranged at a forward end in the main scanning direction of the laser light irradiated onto the photosensitive drum 5. A laser light L3 reflected by the synchronization detecting mirror 6 is detected by a light receiving unit (not shown) inside a synchronization detecting sensor 7 to detect a cycle of a scan with the laser light.

Figure 3:
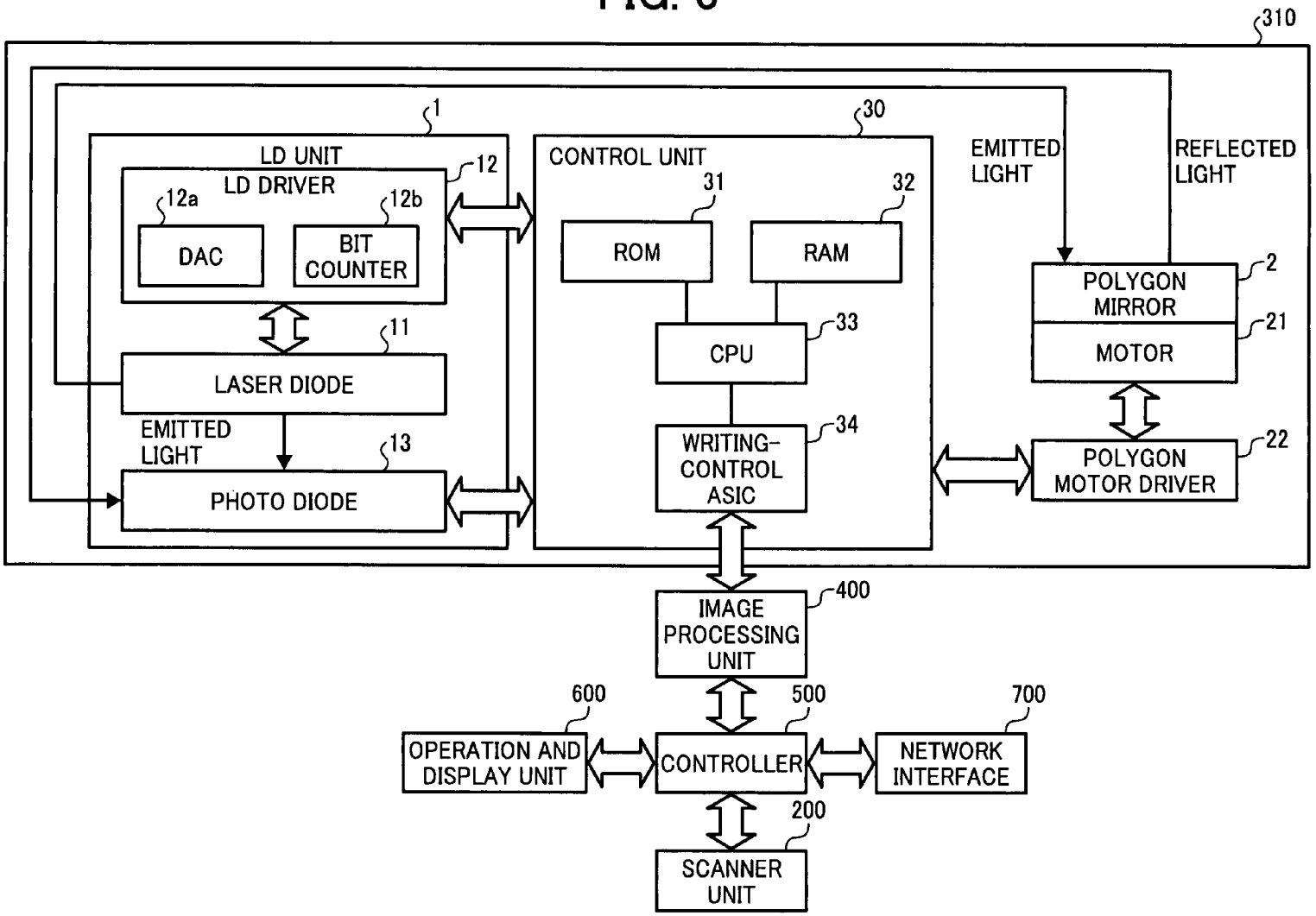
FIG. 3 is a functional block diagram of the optical writing device shown in FIG. 1.

As shown in FIG. 3, the optical writing device 310 broadly includes the LD unit 1 that emits a laser light, the polygon mirror 2 that deflects the laser light emitted from the LD unit 1 for scanning, a motor 21 that rotates the polygon mirror 2, a motor driver 22 that controls rotation of the motor 21, and a control unit 30 that totally controls the optical writing device 310.

The control unit 30 is connected to the image processing unit 400 that creates a writing signal from image data. The image processing unit 400 is connected to a controller 500 that controls import of image data. The controller 500 is connected to an operation and display unit 600 that is configured to display for a controller operator and to receive input from the operator, the scanner unit 200, and a network interface 700 that externally receives an instruction, such as a printing request.

The control unit 30 includes a read only memory (ROM) 31, a random access memory (RAM) 32, a central processing unit (CPU) 33, and a writing-control application specific integrated circuit (ASIC) 34. The ROM 31 stores therein a rotational speed value of the polygon mirror 2, a control program, and the like. The CPU 33 executes a control program. The writing-control ASIC 34 is an exclusive integrated circuit that controls writing with the laser light. The control unit 30 is configured to control operations of an LD 11 and the polygon mirror 2. According to the configuration, as the CPU 33 operates based on the control program stored in the ROM 31 by using a work area in the RAM 32, the writing-control ASIC 34 can control operations of an LD driver 12 and the motor driver 22.

The LD unit 1 includes the LD 11 that emits a laser light, the LD driver 12 that performs illumination control and light-amount adjustment of the LD 11, and a photo diode (PD) 13 that receives the laser light emitted from the LD 11. Operation of the LD unit 1 is controlled by the control unit 30.

The LD 11 as a light-emitting element emits a laser light by being driven with the LD driver 12. The PD 13 as a light-intensity detecting unit detects the laser light, and outputs to the LD driver 12 a photo diode terminal voltage (PD terminal voltage) proportional to the detected light intensity. Although an LD is used as a light-emitting element according to the first embodiment, the present invention is not limited only to this, but also a light emitting diode (LED) or a vertical cavity surface emitting laser (VCSEL) can be used.

The LD driver 12 as a current control unit and an initializing unit converts a current output from the PD 13 into a voltage (PD terminal voltage: Vpd). Moreover, the LD driver 12 includes a digital-to-analog converter (DAC) 12*a*, a bit counter 12*b*, a register, and the like. The DAC 12*a* produces a current proportional to a count value of a digital-analog converter setting code (DAC setting code) of the bit counter 12*b*, and supplies the produced current to the LD 11. The bit counter 12*b* counts a count value of the DAC setting code. The LD driver 12 performs automatic power control (APC), detects the light intensity of a laser light emitted from the LD 11 with the PD 13 to keep the light intensity of the LD 11 constant, and controls a current value (LD drive current Iop) to be supplied to the LD 11 based on the detected light intensity. Furthermore, the LD driver 12 performs an initializing operation to determine the initial value of a current value for obtaining a target light intensity with the LD 11 regardless of an individual difference of the LD 11, time-lapse fluctuations, and temperature fluctuations. The initializing operation is executed on switch-on or during standby.

Figure 4:
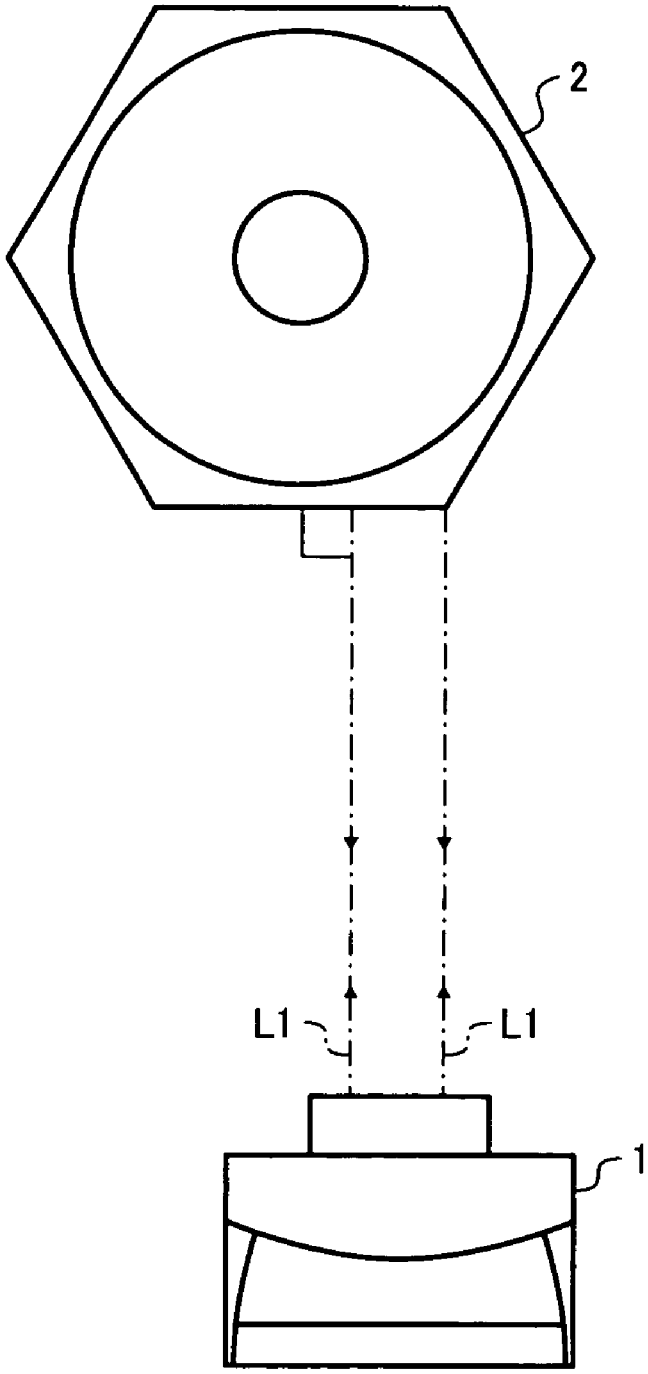
FIG. 4 is a schematic diagram for explaining a phenomenon of a reflected light in the optical writing device shown in FIG. 1.

As described above, when the laser light L1 emitted from the LD unit 1 that includes the LD 11 in its inside is reflected by the polygon mirror 2, as shown in FIG. 4, in accordance with an optical condition of the regular reflection (at 90 degrees of the incident angle), the reflected light sometimes returns directly into the inside of the LD unit 1 in some cases. Such phenomenon is called as a reflected light. If the reflected light is generated, a receiving-light amount received by the PD 13 inside the LD unit 1, i.e., a detected amount of the light intensity of the LD 11, increases to more than a usual state.

For this reason, even when the reflected light is generated, the optical writing device 310 according to the first embodiment is configured to perform an initializing operation that eliminates adverse effects of the reflected light. The initializing operation according to the first embodiment is explained below.

Figure 5:
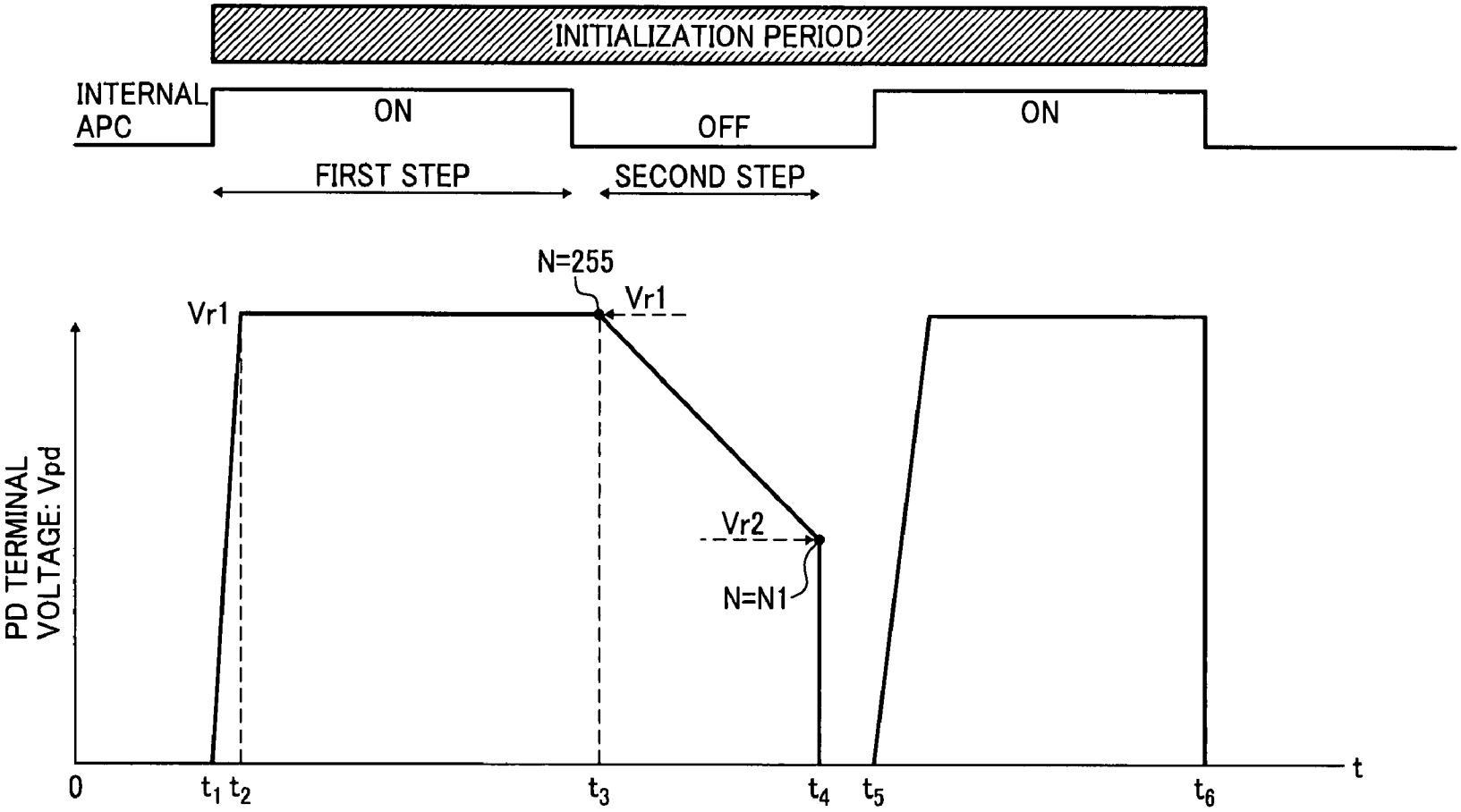
FIG. 5 is a time chart that depicts an initializing operation performed by the optical writing device according to the first embodiment.

FIG. 5 is a time chart that depicts the initializing operation performed by the optical writing device 310 according to the first embodiment. The vertical axis shown in FIG. 5 represents the value of a voltage (PD terminal voltage: Vpd) converted by the LD driver 12 from a current proportional to a light intensity detected by the PD 13. The horizontal axis shown in FIG. 5 represents the time axis (t). An initialization period is a period for performing the initializing operation. It is assumed that the bit counter 12*b* inside the LD driver 12 is an eight bit counter, the highest bit is $N=2^n-1=255$, and the lowest bit is N=0.

To begin with, when the control unit 30 sends an initialization start signal to the LD driver 12, the LD driver 12 counts up a count value (N) of the DAC setting code sequentially from the lowest bit (N=0) by using the bit counter 12*b* as the first step ($t_1$ to $t_2$). While counting up, proportionally to the count value (N) of the DAC setting code, the current supplied from the LD driver 12 to the LD 11 is increased, correspondingly, the light intensity detected by the PD 13 and the PD terminal voltage converted from the current by the LD driver 12 are increased.

When the count value (N) of the DAC setting code reaches the highest bit (N=255), the PD terminal voltage becomes equal to the first reference voltage (Vr1), i.e., Vpd=Vr1 ($t_2$). However, sometimes the PD terminal voltage is a result of receiving an adverse effect of a reflected light in some cases.

As the second step, the APC control is turned to OFF. The LD driver 12 then counts down the count value (N) of the DAC setting code sequentially from the highest bit (N=255). While counting down, proportionally to the count value (N) of the DAC setting code, the current supplied from the LD driver 12 to the LD 11 is decreased, correspondingly, the light intensity detected by the PD 13 and the PD terminal voltage converted from the current by the LD driver 12 is decreased ($t_3$ to $t_4$).

When the PD terminal voltage becomes less than the second reference voltage (Vr2), i.e., Vpd<Vr2, the LD driver 12 then stores a count value (N1) of the DAC setting code at the moment into the register inside the LD driver 12 ($t_4$). The second reference value is smaller than the first reference value.

The LD driver 12 then turns the APC control to ON again, performs the APC control based on the count value (N1) of the DAC setting code stored in the register inside the LD driver 12 ($t_5$ to $t_6$), and then terminates the initializing operation.

When the initializing operation is normally terminated, an initial value of the LD drive current (Iop) is ([2×(255−N1)]: drive current (Idac))+(Ith:lasing threshold current). Afterwards, the APC control is performed by using the initial value of the LD drive current (Iop).

As described above, according to the first embodiment, the initializing operation can be performed normally by eliminating an adverse effect of a reflected light of the laser light, and as a result, a degradation of the image quality can be further prevented.

In other words, while executing the second step, if the PD terminal voltage is temporarily increased due to a reflected light, the PD terminal voltage does not become less than the second reference value, so that the initializing operation is not to be failed, consequently, degradation of the image quality can be prevented.

An initializing operation according to a second embodiment of the present invention performed by the optical writing device 310 is explained below. Some explanations overlapping with those of the first embodiment are omitted in explanations of the second embodiment.

According to the first embodiment, the LD driver 12 calculates the initial value of LD drive current (Iop) based on the count value (N1) of the DAC setting code at the moment when the PD terminal voltage becomes less than the second reference value.

By contrast, according to the second embodiment, after the PD terminal voltage becomes less than the second reference value, the LD driver 12 further counts down the count value (N) of the DAC setting code sequentially, and if the PD terminal voltage remains less than the second reference value continuously for a predetermined time, the LD driver 12 calculates an initial value of LD drive current (Iop) based on the count value (N1) of the DAC setting code at the moment when the PD terminal voltage becomes less than the second reference value.

Figure 6:
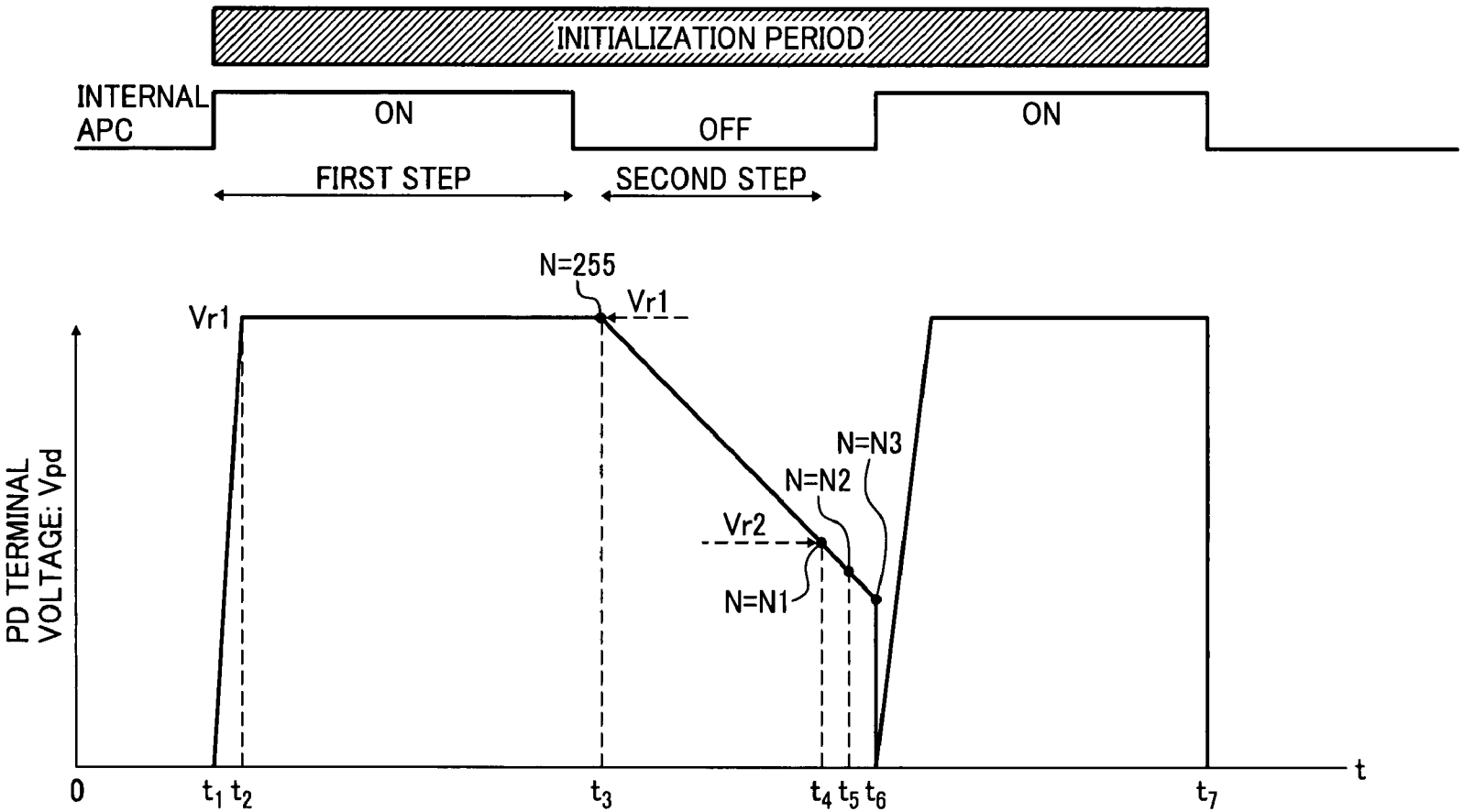
FIG. 6 is a time chart that depicts an initializing operation performed by the optical writing device according to a second embodiment of the present invention.

The initializing operation according to the second embodiment performed by the optical writing device 310 is explained below with reference to FIG. 6. Because the operation performed at the first step is similar to the first embodiment, the explanation of the operation is omitted.

As the second step, the APC control is turned to OFF. The LD driver 12 then sequentially counts down the count value (N) of the DAC setting code from the highest bit (N=255) ($t_3$ to $t_4$). By sequentially counting down the count value (N) of the DAC setting code, the PD terminal voltage is sequentially decreased.

The PD terminal voltage then becomes not to satisfy the second reference value ($t_4$). It is assumed that a count value (N) of the DAC setting code at the moment is N1.

Subsequently, the LD driver 12 counts down the count value (N) of the DAC setting code sequentially from N1 to N2, and then to N3 ($t_4$ to $t_6$). The range of the value of N2 can be expressed as 0<N2<N1. The range of the value of N3 can be expressed as 0=3<N2.

When the PD terminal voltage is less than the second reference value in both states where the count values (N) of the DAC setting code are N2 and N3, the LD driver 12 stores the count value (N1) of the DAC setting code at the moment when the PD terminal voltage becomes less than the second reference value into the register ($t_6$).

The LD driver 12 then turns the APC control to ON again, performs the APC control based on the count value (N1) of the DAC setting code stored in the register inside the LD driver 12 ($t_6$ to $t_7$) and then terminates the initializing operation ($t_7$). When the initializing operation is normally terminated, an initial value of the LD drive current (Iop) is ([2×(255−N1)]:drive current (Idac))+(Ith:lasing threshold current). Afterwards, the APC control is performed by using the initial value of the LD drive current (Iop).

As described above, according to the second embodiment, the initializing operation can be performed more normally by eliminating an adverse effect of a reflected light of the laser light, and as a result, a degradation of the image quality can be further prevented.

An initializing operation according to a third embodiment of the present invention performed by the optical writing device 310 is explained below. Some explanations overlapping with those of the first and second embodiments are omitted in explanations of the third embodiment.

According to the third embodiment, after the PD terminal voltage becomes less than the second reference value, the LD driver 12 further counts down the count value (N) of the DAC setting code sequentially from N1 to N2, and in turn counts up it from N2 to N3 such that the PD terminal voltage exceeds the second reference value. The LD driver 12 then stores into the register an average between the count value (N1) and the count value (N3), which is a count value at a moment when the PD terminal voltage exceeds the second reference value, and calculates an initial value of LD drive current (Iop) based on the count value ((N1+N3)/2) of the DAC setting code stored in the register.

Figure 7:
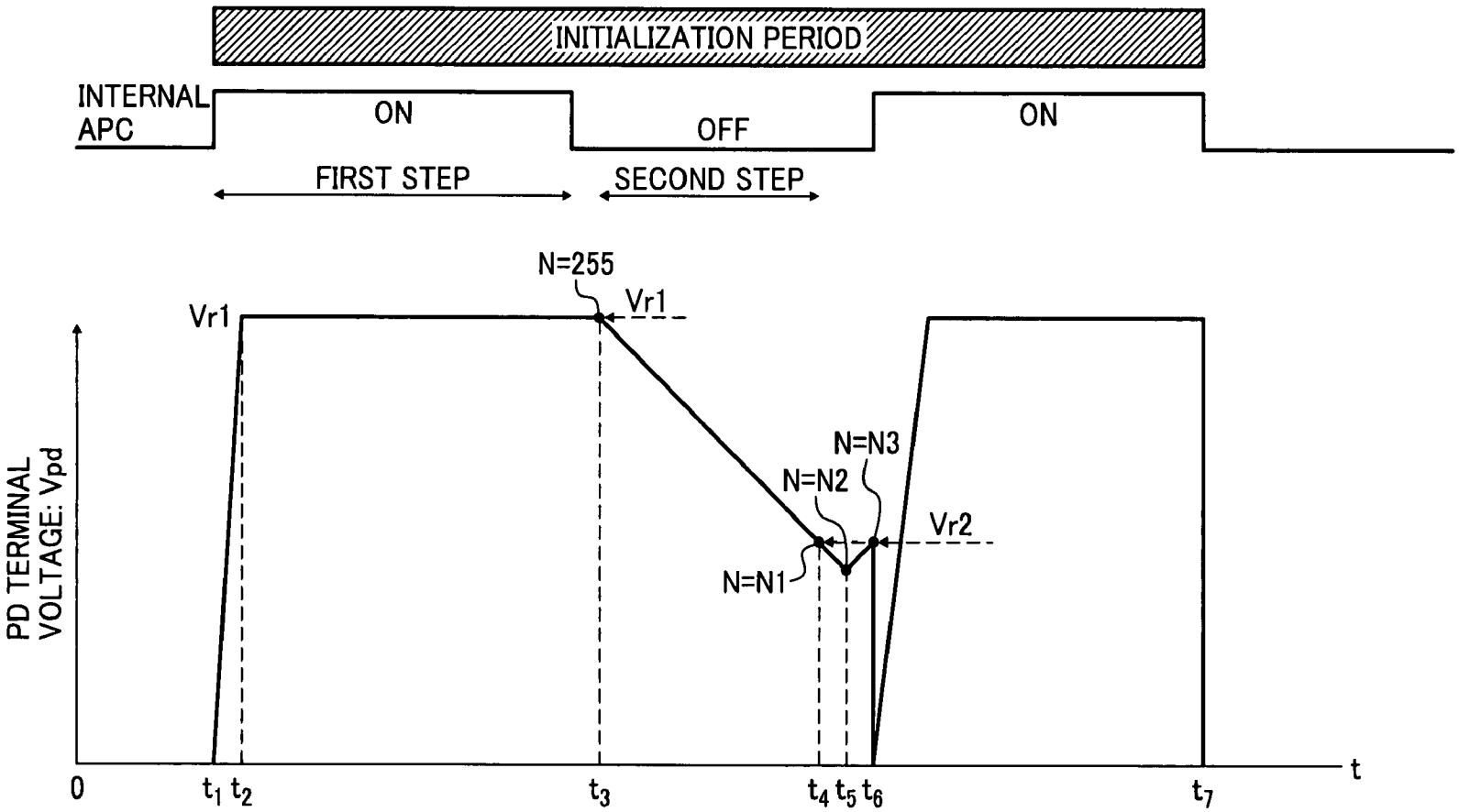
FIG. 7 is a time chart that depicts an initializing operation performed by the optical writing device according to a third embodiment of the present invention.

The initializing operation according to the third embodiment performed by the optical writing device 310 is explained with reference to in FIG. 7. Because the operation performed at the first step is similar to the first embodiment, the explanation of the operation is omitted.

As the second step, the APC control is turned to OFF. The LD driver 12 then sequentially counts down the count value (N) of the DAC setting code from the highest bit (N=255) ($t_3$ to $t_4$). By sequentially counting down the count value (N) of the DAC setting code, the PD terminal voltage is sequentially decreased.

The PD terminal voltage then becomes less than the second reference value ($t_4$). It is assumed that a count value (N) of the DAC setting code at the moment is N1.

Subsequently, the LD driver 12 counts down the count value (N) of the DAC setting code sequentially from N1 to N2 ($t_4$ to $t_5$). The range of the value of N2 can be expressed as 0=N2<N1.

When the count value (N) of the DAC setting code reaches N2 ($t_5$), the LD driver 12 counts up the count value (N) sequentially from N2. Afterwards, when the PD terminal voltage exceeds the second reference value (Vpd>Vr2), the LD driver 12 stores an average ((N1+N3)/2) between the count value (N3) of the DAC setting code at the moment and the count value (N1) into the register ($t_6$).

The LD driver 12 then turns the APC control to ON again, performs the APC control based on the count value ((N1+N3)/2) of the DAC setting code stored in the register inside the LD driver 12 ($t_6$ to $t_7$), and then terminates the initializing operation ($t_7$).

When the initializing operation is normally terminated, an initial value of the LD drive current (Iop) is ([2×(255−((N1+N3)/2))]:drive current (Idac))+(Ith:lasing threshold current). Afterwards, the APC control is performed by using the initial value of the LD drive current (Iop).

If even though the count value (N2) of the DAC setting code is sequentially counted up to a predetermined multiple (for example, a count value of N2×1.1), the PD terminal voltage does not exceed the second reference value, the LD driver 12 terminates the initializing operation, and notifies a user of such state via the operation and display unit 600.

As described above, according to the third embodiment, the initializing operation can be performed more normally by eliminating an adverse effect of a reflected light of the laser light, and as a result, a degradation of the image quality can be further prevented.

Moreover, a user can recognizes a case that the LD driver 12 erroneously detects timing at which the PD terminal voltage becomes less than the second reference value.

An initializing operation according to a fourth embodiment of the present invention performed by the optical writing device 310 is explained below. Some explanations overlapping with those of the first to third embodiments are omitted in explanations of the fourth embodiment.

According to the fourth embodiment, after the PD terminal voltage becomes less than the second reference value, the LD driver 12 further counts down the count value (N) of the DAC setting code sequentially from N1 and keeps the count value (N) at a constant value (N2), and then if the PD terminal voltage remains less than the second reference value continuously for a predetermined time, the LD driver 12 stores the count value (N1) of the DAC setting code at the moment when the PD terminal voltage becomes less than the second reference value into the register, and then calculates an initial value of LD drive current (Iop) based on the count value (N1) stored in the register.

Figure 8:
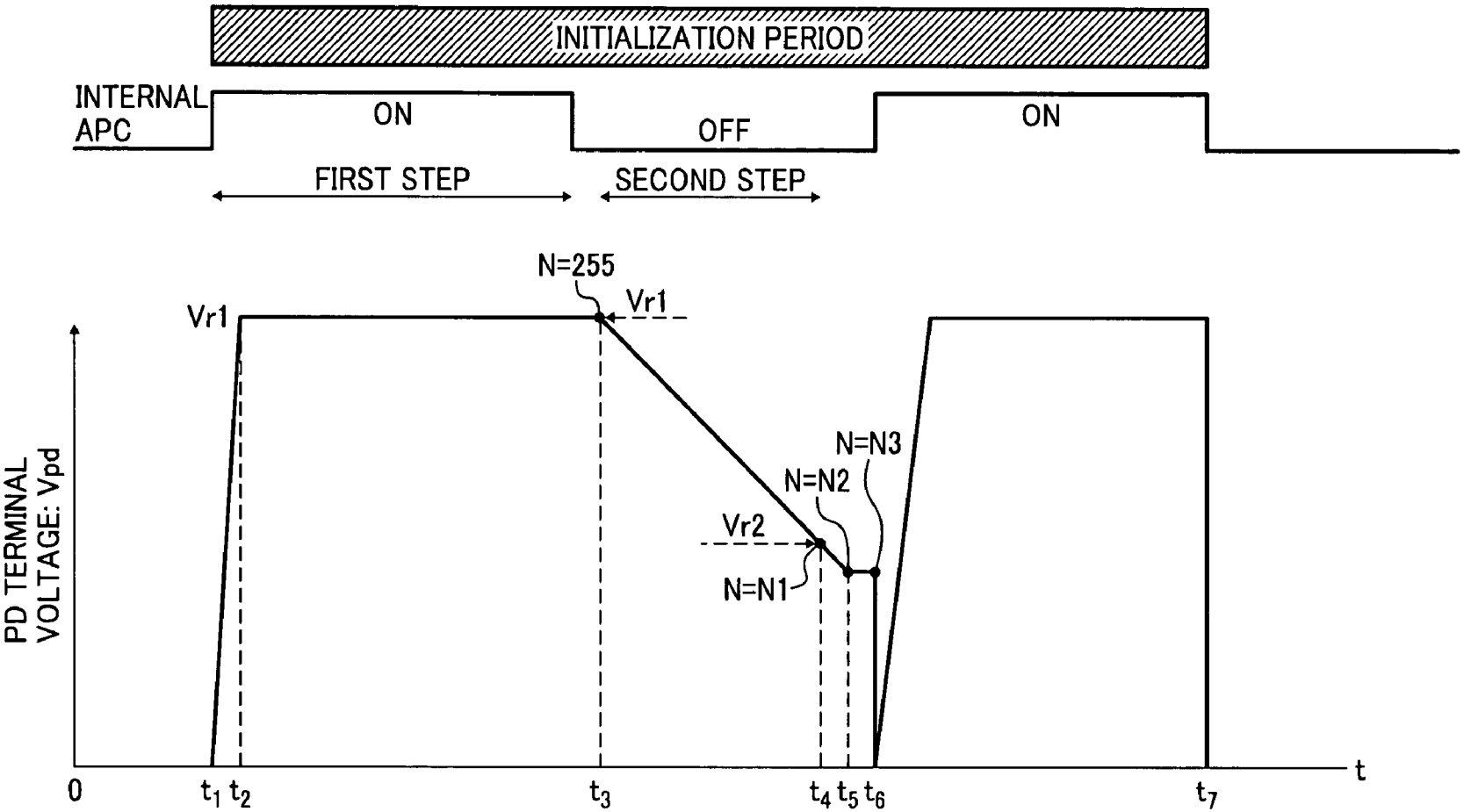
FIG. 8 is a time chart that depicts an initializing operation performed by the optical writing device according to a fourth embodiment of the present invention.

The initializing operation according to the fourth embodiment performed by the optical writing device 310 is explained with reference to FIG. 8. Because the operation performed at the first step is similar to the first embodiment, the explanation of the operation is omitted.

As the second step, the APC control is turned to OFF. The LD driver 12 then sequentially counts down the count value (N) of the DAC setting code from the highest bit (N=255) ($t_3$ to $t_4$). By sequentially counting down the count value (N) of the DAC setting code, the PD terminal voltage is sequentially decreased.

The PD terminal voltage then becomes less than the second reference value ($t_4$). It is assumed that a count value (N) of the DAC setting code at the moment is N1.

According to the fourth embodiment, subsequently, the LD driver 12 counts down the count value (N) of the DAC setting code sequentially from N1 to N2 ($t_4$ to $t_5$). The range of the value of N2 can be expressed as 0<N2<N1.

When the count value (N) of the DAC setting code reaches N2 ($t_5$), the LD driver 12 keeps the count value (N) of the DAC setting code at a constant value (N2), and then if the PD terminal voltage remains less than the second reference value continuously for a predetermined time ($t_5$ to $t_6$), the LD driver 12 stores the count value (N1) of the DAC setting code at the moment when the PD terminal voltage becomes less than the second reference value into the register ($t_6$).

The LD driver 12 then turns the APC control to ON again, performs the APC control based on the count value (N1) of the DAC setting code stored in the register inside the LD driver 12 ($t_6$ to $t_7$), and then terminates the initializing operation ($t_7$). When the initializing operation is normally terminated, an initial value of the LD drive current (Iop) is ([2×(255−N1)]:drive current (Idac))+(Ith:lasing threshold current).

In the case that the LD driver 12 keeps the count value (N) of the DAC setting code at the constant value (N2), sometimes the PD terminal voltage does not remains less than the second reference value continuously for the predetermined time ($t_5$ to $t_6$) in some cases. In such case, the similar processing described above is repeated.

In other words, the LD driver 12 again counts down the count value (N) of the DAC setting code sequentially from the highest bit (N=255) until the PD terminal voltage becomes not to satisfy the second reference value. It is assumed that a count value (N) of the DAC setting code at a moment when the PD terminal voltage becomes not to satisfy the second reference value is N3. The LD driver 12 then further counts down the count value (N) of the DAC setting code sequentially from N3 to N4. The range of the value of N4 can be expressed as 0<N4<N3.

The LD driver 12 then fixes the count value (N) of the DAC setting code at a constant value (N4), and confirms whether the PD terminal voltage remains less than the second reference value continuously for the predetermined time. If the LD driver 12 can confirm that the PD terminal voltage remains less than the second reference value continuously for the predetermined time, the LD driver 12 stores N3 as the count value (N) of the DAC setting code into the register.

As described above, according to the fourth embodiment, the initializing operation can be performed more normally by eliminating an adverse effect of a reflected light of the laser light, and as a result, a degradation of the image quality can be further prevented.

Moreover, after the count value of the DAC setting code obtained by eliminating an adverse effect of a reflected light of the laser light is measured, the initial value of the LD drive current (Iop) can be calculated.

An initializing operation according to a fifth embodiment of the present invention performed by the optical writing device 310 is explained below. Some explanations overlapping with those of the first to fourth embodiments are omitted in explanations of the fifth embodiment.

According to the fifth embodiment, the LD driver 12 sequentially increases a current to be supplied to the LD 11, samples light intensities of the LD 11 detected by the PD 13 a plurality of number of times while a current at the same current value is being supplied to the LD 11, and determines whether the light intensities at the current value are normal.

Figure 9:
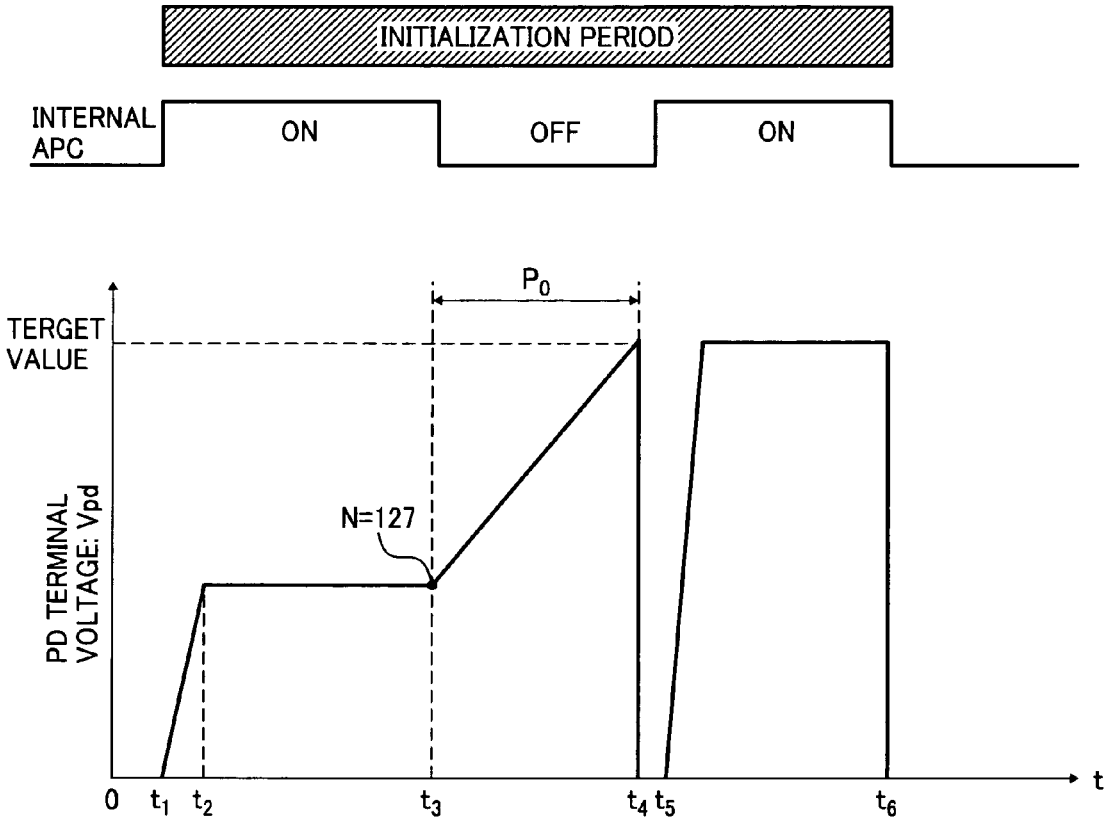
FIG. 9 is a time chart that depicts an initializing operation performed by the optical writing device according to a fifth embodiment of the present invention.

FIG. 9 is a time chart that depicts the initializing operation according to the fifth embodiment performed by the optical writing device 310. The vertical axis shown in FIG. 9 represents the value of a voltage (PD terminal voltage:Vpd) converted by the LD driver 12 from a current proportional to a light intensity detected by the PD 13, and the horizontal axis represents the time axis (t).

To begin with, when the control unit 30 sends an initialization start signal to the LD driver 12, the LD driver 12 counts up the count value (N) of the DAC setting code sequentially from the lowest bit (N=0) by using the bit counter 12*b* ($t_1$ to $t_2$). While counting up, proportionally to the count value (N) of the DAC setting code, the current supplied from the LD driver 12 to the LD 11 is increased, correspondingly, the light intensity detected by the PD 13 and the PD terminal voltage converted from the current by the LD driver 12 are increased.

When the count value (N) of the DAC setting code reaches an intermediate bit (for example, N=127), the LD driver 12 turns the APC control to ON and performs the APC control. The LD driver 12 then holds the APC control OFF during a period $P_0$, and counts up the count value (N) of the DAC setting code sequentially from the intermediate bit (N=127). While counting up, proportionally to the count value (N) of the DAC setting code, the current supplied from the LD driver 12 to the LD 11 is increased, correspondingly, the light intensity detected by the PD 13 and the PD terminal voltage converted from the current by the LD driver 12 are increased ($t_3$ to $t_4$). During the period $P_0$, the LD driver 12 stores a count value ($N_S$) of the DAC setting code to be a target light intensity of the LD 11 into the register. A current value corresponding to the count value ($N_S$) is to be an initial value of the LD drive current (Iop). During the period $P_0$, as described later, the light intensity is detected by eliminating an adverse effect of a noise.

The LD driver 12 then turns the APC control to ON again, performs the APC control based on the count value ($N_S$) of the DAC setting code stored in the register inside the LD driver 12 ($t_5$ to $t_6$), and then terminates the initializing operation ($t_6$).

A light-intensity detecting process during the period $P_0$ shown in FIG. 9 is explained below with reference to FIG. 10.

Figure 10:
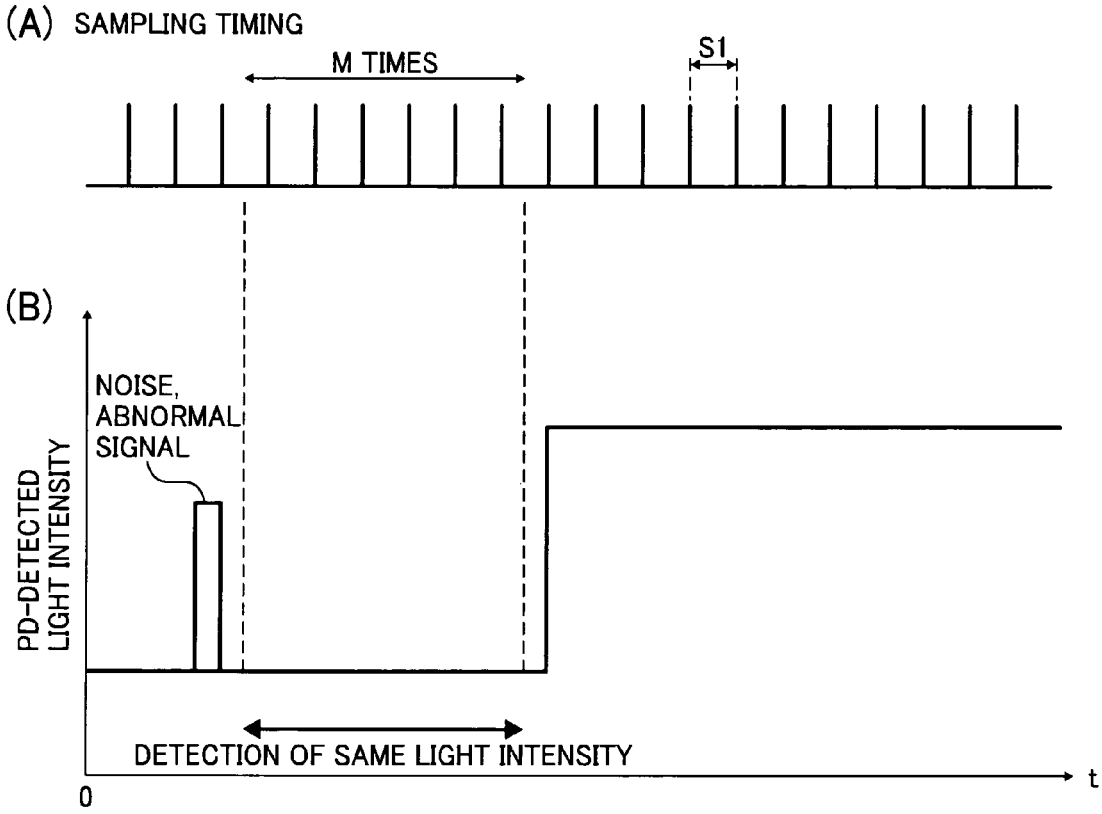
FIG. 10 is a timing chart for explaining a light-intensity detecting process during a period $P_0$ shown in FIG. 9.

A section (A) in FIG. 10 depicts sampling timing of the light intensities (PD terminal voltages) of the LD 11 detected by the PD 13, and a section (B) in FIG. 10 depicts the light intensities (PD terminal voltages) of the LD 11 detected by the PD 13. According to the fifth embodiment, as shown in FIG. 10, the LD driver 12 samples light intensities (PD terminal voltages) of the LD 11 with a sampling interval S1 a plurality of number of times while the same current is passing through the LD 11 (while the same DAC code is set), and if the sampled light intensities (PD terminal voltages) take the substantially same value M times or more, the LD driver 12 determines that the light amount detection at the current is normally performed.

Figure 11:
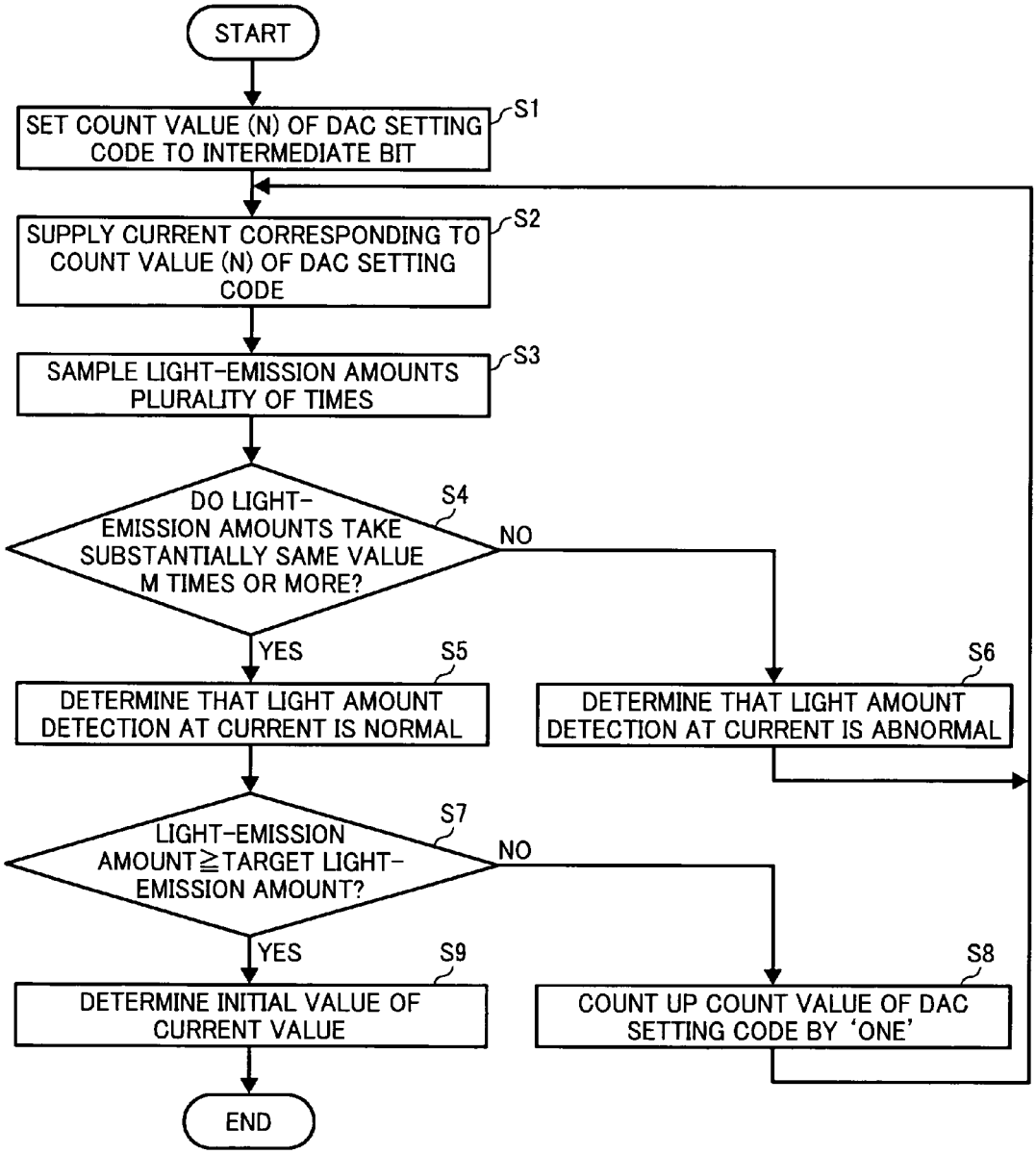
FIG. 11 is a flowchart for explaining the light-intensity detecting process during the period $P_0$.

The light-intensity detecting process during the period $P_0$ is explained below with reference to FIG. 11. To begin with, the LD driver 12 sets the count value (N) of the DAC setting code to 127 of the intermediate bit (Step S1), and supplies a current corresponding to the count value (N) of the DAC setting code to the LD 11 for a predetermined time (Step S2). During a period during which the same current is passing through the LD 11 (while the same DAC code is set), the LD driver 12 samples light intensities (PD terminal voltages) a plurality of number of times (Step S3), and determines whether the sampled light intensities (PD terminal voltages) take the substantially same value M times or more (Step S4). If the sampled light intensities (PD terminal voltages) do not take the substantially same value M times or more (No at Step S4), the LD driver 12 determines that light amount detection at the current is abnormal (Step S6), goes back to Step S1, and again detects light intensities (PD terminal voltages) at the same current value (Steps S1 to S4).

By contrast, if the sampled light intensities (PD terminal voltages) take the substantially same value M times or more (Yes at Step S4), the LD driver 12 determines that the light amount detection at the current is normally performed (Step S5). The LD driver 12 then determines whether the sampled light intensity (PD terminal voltage) is equal to or more than the target light intensity (target voltage) (Step S7). If the sampled light intensity (PD terminal voltage) is not equal to or more than the target light intensity (target voltage) (No at Step S7), the LD driver 12 counts up the count value (N) of the DAC setting code by one (Step S8), and performs light amount detection by the same process at a current value that is based on the counted-up count value (N) of the DAC setting code (Steps S1 to S7). If the sampled light intensity (PD terminal voltage) is equal to or more than the target light intensity (target voltage) (Yes at Step S7), the LD driver 12 determines that an initial value of the LD drive current (Iop) is a current value based on the count value ($N_S$) of the DAC setting code at which the light intensity (PD terminal voltage) is equal to or more than the target light intensity (target voltage) (Step S9).

As described above, according to the fifth embodiment, even if a noise caused by a reflected light of the laser light is detected, correct light-amount detection can be performed, and the initialization can be normally performed by eliminating an adverse effect of the reflected light of the laser light.

Moreover, according to the fifth embodiment, an adverse effect of a noise caused by a reflected light of the laser light can be eliminated by a simple process.

Figure 12:
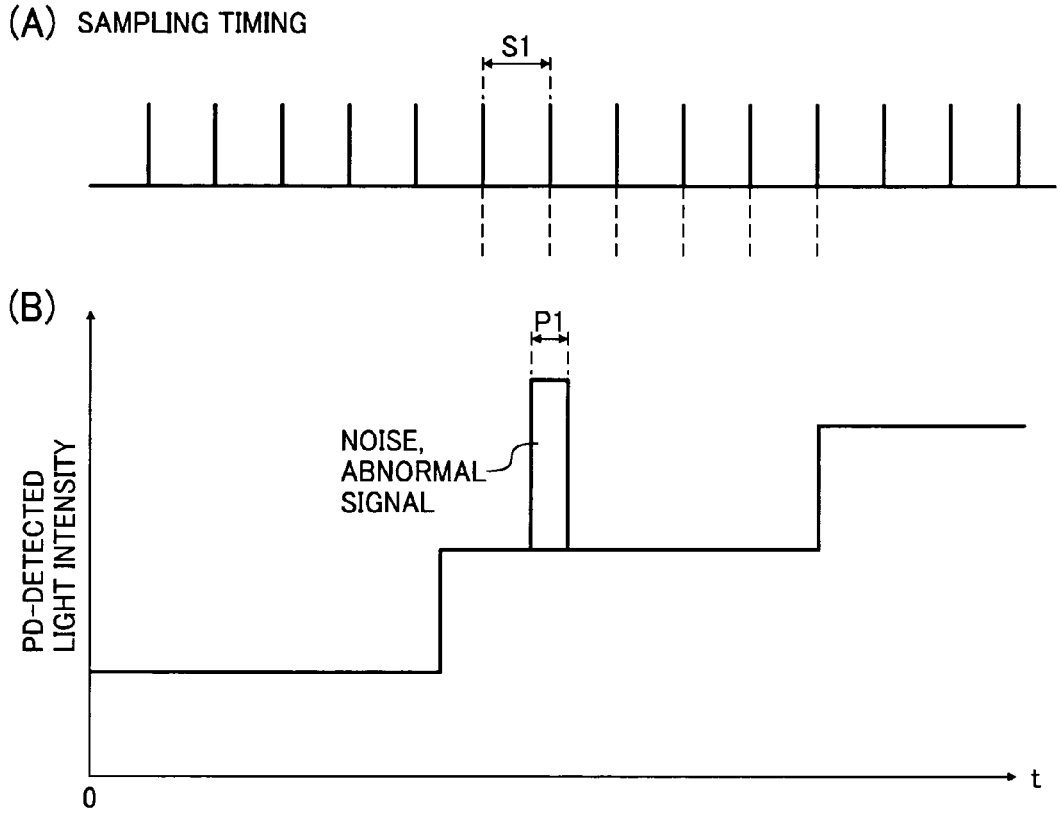
FIG. 12 is a timing chart for explaining a first modification example of the fifth embodiment.

As shown in FIG. 12, according to the first modification example of the light-intensity detecting process in the fifth embodiment, the sampling interval S1 for sampling the light intensities (PD terminal voltages) is set longer than a noise-generated period P1.

As described above, because timing of an incidence of a reflected light of the laser light from the polygon mirror 2 into the LD unit 1 and its reflected light generated period are known in advance based on the layout of the optical system and the rotational frequency of the polygon mirror 2, the sampling interval S1 for sampling the PD terminal voltage can be set longer than the noise-generated period P1. The timing of the incidence of a reflected light into the LD unit 1 and its reflected light generated period vary in accordance with the rotational frequency of the polygon mirror 2, accordingly, the sampling interval S1 is changed in accordance with the rotational frequency of the polygon mirror 2.

According to the first modification example, if a noise is generated during the sampling interval (during suspension of sampling), the initializing operation can be normally performed without detecting the noise, and even if a noise is generated during the sampling, the noise can be determined as an abnormal value, so that the light amount detection is performed until the substantially same light intensities are detected M times or more, accordingly, the initializing operation can be normally performed.

Moreover, the initializing operation can be normally performed regardless of the rotational frequency of the polygon mirror 2.

Figure 13:
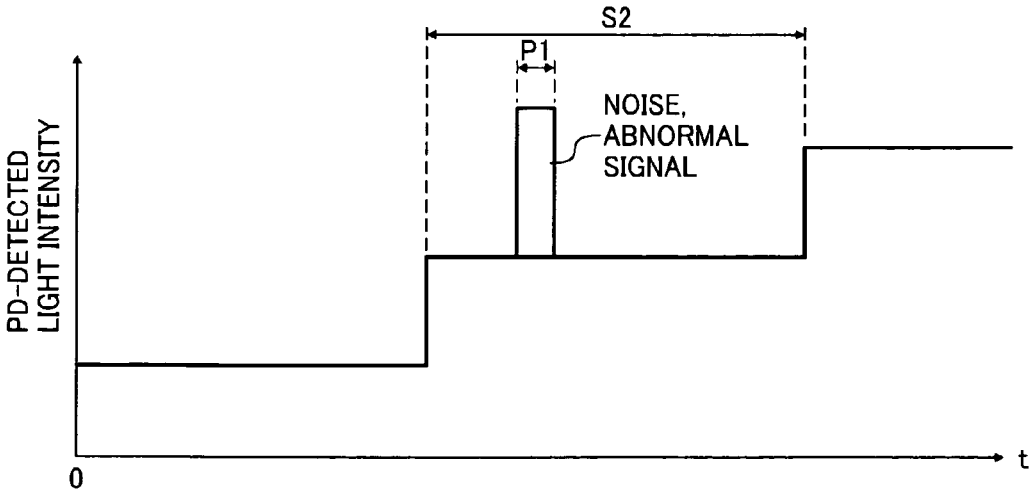
FIG. 13 is a timing chart for explaining a second modification example of the fifth embodiment.

As shown in FIG. 13, according to the second modification example of the light-intensity detecting process in the fifth embodiment, a period S2 during which the light amount is detected at the same current value is set longer than the noise-generated period P1, i.e., S2>P1. Because the timing of the incidence of a reflected light of the laser light into the LD unit 1 and its reflected light generated period are known in advance based on the layout of the optical system and the rotational frequency of the polygon mirror 2, the light-intensity detecting period S2 can be set longer than the noise-generated period P1.

Figure 14:
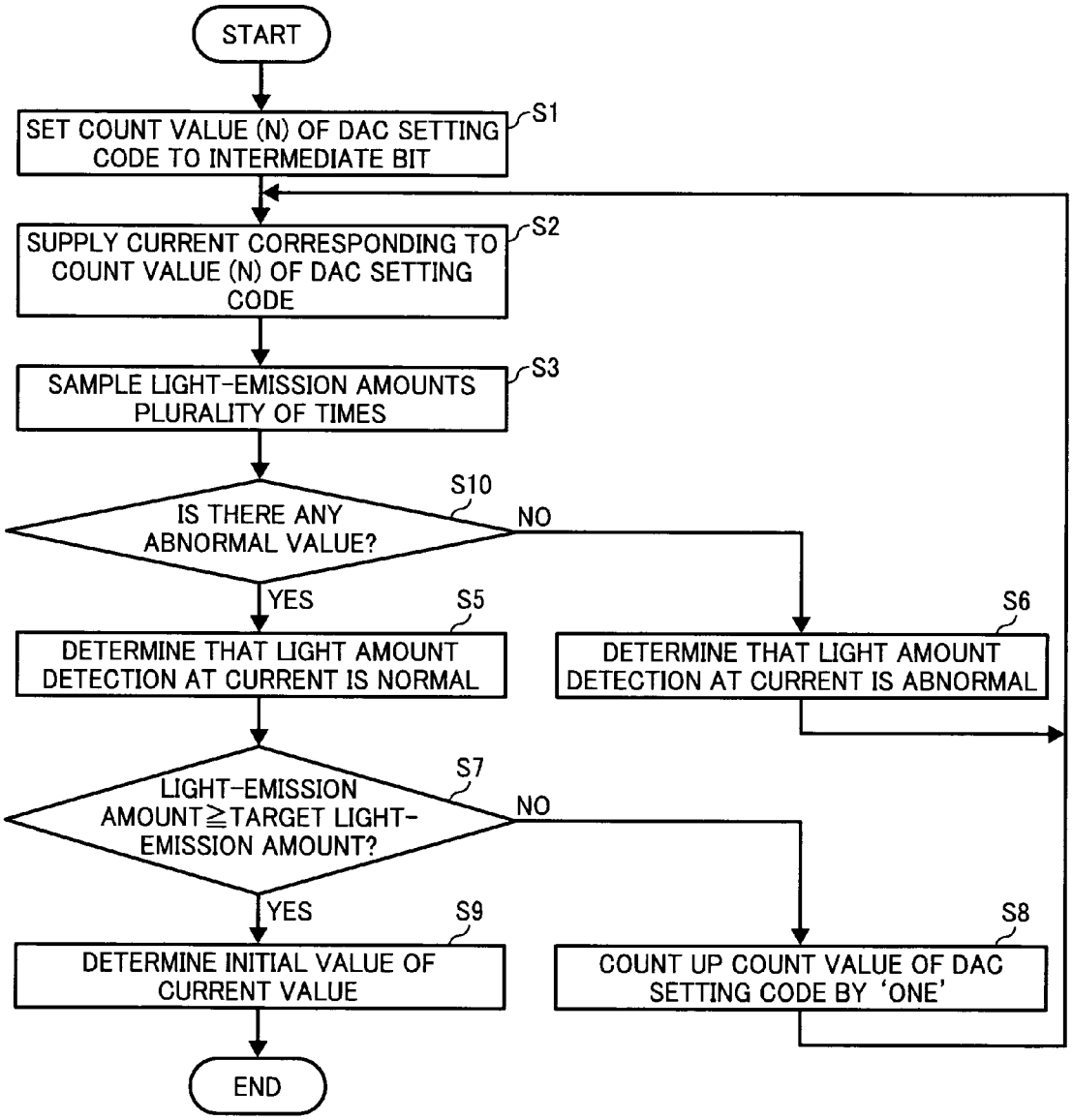
FIG. 14 is a flowchart for explaining the second modification example.

FIG. 14 is a flowchart for explaining the second modification example of the light-intensity detecting process during the period $P_0$. The steps shown in FIG. 14 for performing the similar processing to those in the flowchart shown in FIG. 11 are assigned with the same step numbers, explanations of them are omitted, and only different processing are explained below.

At Step S10 shown in FIG. 14, the LD driver 12 determines whether there is any abnormal value among the sampled light intensities (PD terminal voltages). If there is any abnormal value among the sampled light intensities (PD terminal voltages) (Yes at Step S10), the LD driver 12 determines that the light amount detection with the current is abnormal (Step S5), goes back to Step S1, and detects light intensities (PD terminal voltages) again at the same current value (Steps S1 to S10).

By contrast, if there is no abnormal value among the sampled light intensities (PD terminal voltages) (No at Step S10), the LD driver 12 determines that the light amount detection is normally performed (Step S5).

According to the second modification example, even if a noise caused by a reflected light of the laser light is detected, the light intensity of the LD 11 can be correctly detected again with the same current value, and the initialization can be normally performed by eliminating an adverse effect of the reflected light of the laser light.

Figure 15:
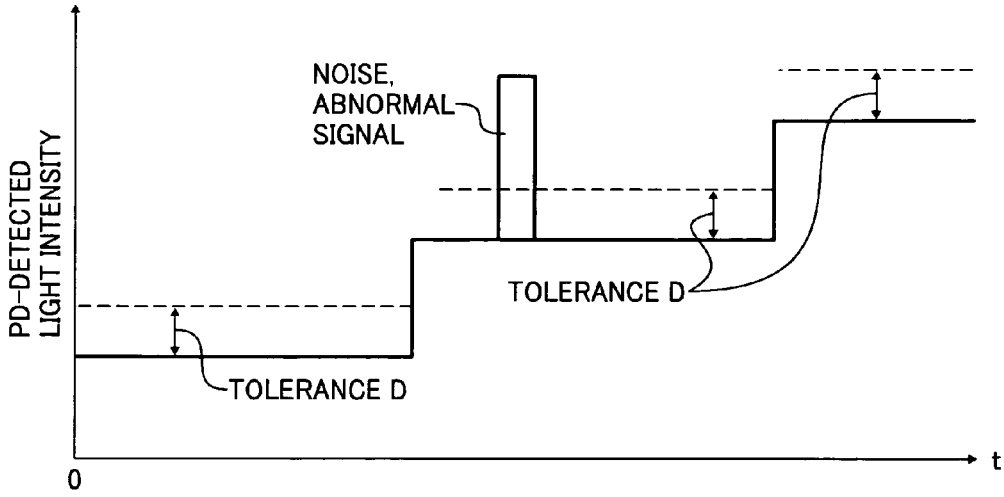
FIG. 15 is a timing chart for explaining the second modification example.

FIG. 15 is a timing chart for explaining a process of detecting an abnormal value. The abnormal value can be determined according to the following method. For example, as shown in FIG. 15, a tolerance D is to be set for each light amount in a light intensity detection period, and if the light intensity exceeds the tolerance D, it is determined as abnormal, by contrast, if the light intensity is within the tolerance D, it is determined as normal.

Figure 16:
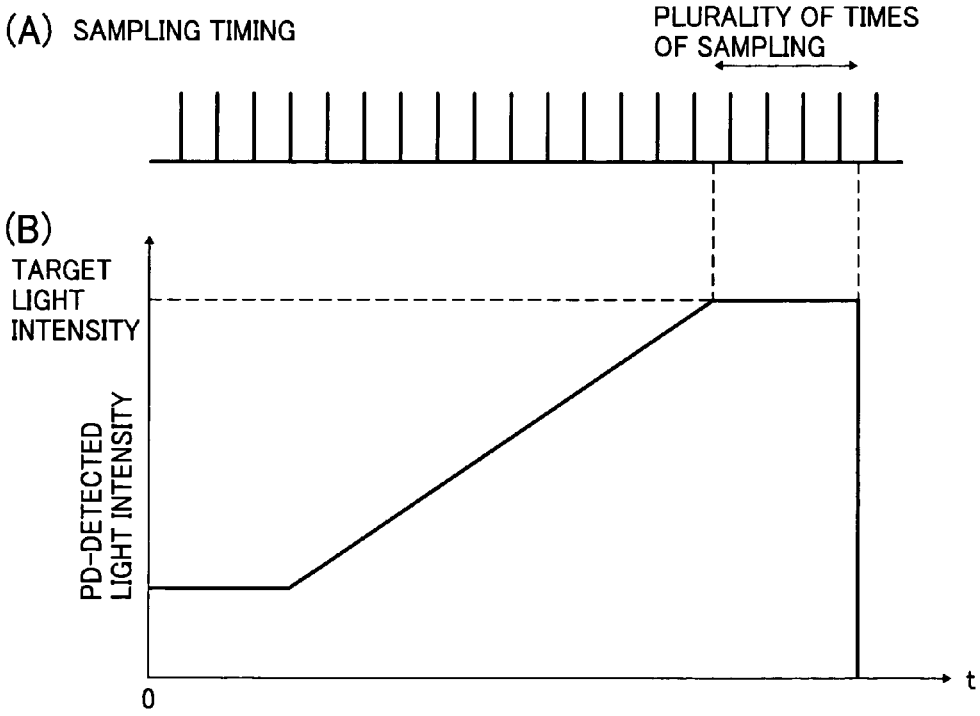
FIG. 16 is a timing chart for explaining a third modification example of the fifth embodiment.

According to the third modification example of the light-intensity detecting process in the fifth embodiment, as shown in FIG. 16, when the light intensity of the LD 11 reaches the target light intensity, sampling of the light intensity is performed a plurality of number of times, and it is determined whether the initializing operation is normally performed.

Figure 17:
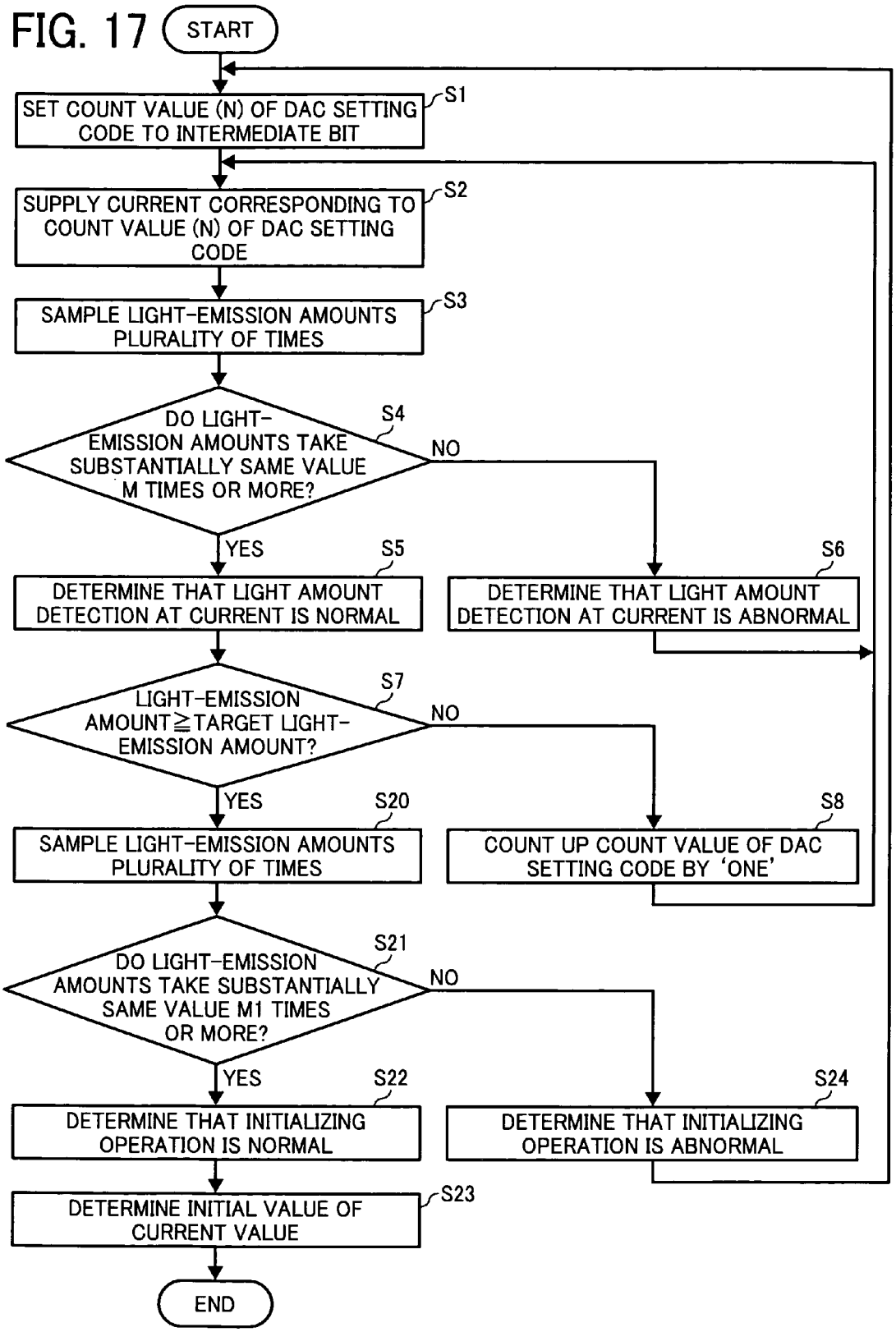
FIG. 17 is a flowchart for explaining the third modification example.

FIG. 17 is a flowchart for explaining the third modification example of the light-intensity detecting process during the period $P_0$. The steps shown in FIG. 17 for performing the same processing as those in the flowchart shown in FIG. 11 are assigned with the same step numbers, explanations of the common steps are omitted, and only different points are explained below.

At Step S7 shown in FIG. 17, if the light intensity (PD terminal voltage) is equal to or more than the target light intensity (target voltage) (Yes at Step S7), the LD driver 12 samples light intensities (PD terminal voltages) a plurality of number of times at the current value (Step S20), and determines whether the substantially same light intensities (PD terminal voltages) are sampled M1 times or more (Step S21). If the substantially same light intensities (PD terminal voltages) are sampled M1 times or more (Yes at Step S21), the LD driver 12 determines the initializing operation is normal (Step S22), and determines that an initial value of the LD drive current (Iop) is the current value based on the count value ($N_S$) of the DAC setting code at which the light intensity (PD terminal voltage) is equal to or more than the target light intensity (target voltage) (Step S23). By contrast, the substantially same light intensities (PD terminal voltages) are not sampled M1 times or more (No at Step S21), the LD driver 12 determines that the initializing operation is abnormal (Step S24), goes back to Step S1, and performs the initializing operation from the beginning.

According to the third modification example, determination whether the initializing operation is normally finished can be performed by a simple process.

Although a monochrome digital photocopier is exemplified as an image forming apparatus in the explanations of the first to fifth embodiments, the present invention is not limited to this, but can also be applied to other image forming apparatuses, such as a color digital photocopier, a digital multiple-function processing machine, and a laser printer.

With the embodiments of the present invention, an optical writing device that can normally perform an initialization by eliminating an adverse effect of a reflected light of a laser light can be provided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An optical writing device comprising:

a light-emitting element that emits a laser light;

a rotating deflection unit that deflects the laser light and that performs a scanning with the laser light;

a light-intensity detecting unit that detects a light intensity of the laser light;

a current control unit that controls a current to be supplied to the light-emitting element in such manner that the light intensity of the laser light reaches a target light intensity; and an initializing unit that determines an initial current value with which the target light intensity is obtained from the light-emitting element by eliminating an influence of a noise caused by a reflected light input into the light-intensity detecting unit from the rotating deflection units, wherein the laser light that the light-emitting element emits and the reflected light reflected by the rotating deflection unit in regular reflection are both incident into the light-intensity detecting unit so that the noise is generated.

2. The optical writing device according to claim 1, wherein the initializing unit sequentially increases the current to be supplied to the light-emitting element, causes the light-intensity detecting unit to sample the light intensity a plurality of times during a first current is supplied to the light-emitting element, and determines whether the light intensity is normal at the first current, and when it is determined that the light intensity is normal, the light-intensity detecting unit detects the light intensity at a second current, and when it is determined that the light intensity is abnormal, the light-intensity detecting unit detects the light intensity again at the first current.

3. The optical writing device according to claim 2, wherein after the light intensity reaches the target light intensity, the initializing unit keeps supplying the current at the value with which the target light intensity is obtained, causes the light-intensity detecting unit to sample the light intensity a plurality of times, when substantially same light intensities are detected a predetermined times, the initializing unit determines that an initialization is normally completed, and otherwise, the initializing unit determines that the initialization is abnormal, and starts over the initialization again.

4. An image forming apparatus that forms an electrostatic latent image on an image carrier by irradiating the image carrier with a laser light and forms a toner image on a recording medium by developing the electrostatic latent image with toner, the image forming apparatus comprising:

an optical writing device that scans the image carrier with a laser light to form electrostatic latent image on the image carrier, the optical writing device including a light-emitting element that emits a laser light, a rotating deflection unit that deflects the laser light and that performs a scanning with the laser light, a light-intensity detecting unit that detects a light intensity of the laser light, a current control unit that controls a current to be supplied to the light-emitting element in such manner that the light intensity of the laser light reaches a target light intensity, and an initializing unit that determines an initial current value with which the target light intensity is obtained from the light-emitting element by eliminating an influence of a noise caused by a reflected light input into the light-intensity detecting unit from the rotating deflection unit, wherein the laser light that the light-emitting element emits and the reflected light reflected by the rotating deflection unit in regular reflection are both incident into the light-intensity detecting unit so that the noise is generated.

* * * * *